US005105568A

United States Patent [19]

Branning

[11] Patent Number: 5,105,568

[45] Date of Patent: Apr. 21, 1992

[54] ILLUMINATED SIGN HAVING STENCIL PANEL AND REFLECTOR PANEL

[75] Inventor: Lester W. Branning, St. Petersburg, Fla.

[73] Assignee: Innovative Products Group, Inc., Clearwater, Fla.

[21] Appl. No.: 693,930

[22] Filed: Apr. 29, 1991

[51] Int. Cl.[5] ..... G09F 23/00

[52] U.S. Cl. ..... 40/570; 40/580

[58] Field of Search ..... 40/570, 580, 579, 564, 40/552, 577; 362/812, 31, 241, 245, 254

[56] References Cited

U.S. PATENT DOCUMENTS

| | | | |
|---|---|---|---|
| 644,015 | 2/1900 | Jean et al. | 40/580 |
| 769,138 | 8/1904 | Hotchner | 40/552 |
| 1,296,109 | 3/1919 | Ohrt | 40/564 |
| 1,761,868 | 6/1930 | Burke | 40/580 |
| 1,804,651 | 5/1931 | Shipman | 40/564 |
| 1,838,415 | 12/1931 | Lawrence | 40/579 |
| 1,944,276 | 1/1934 | Shepmoes | 40/570 |
| 2,152,844 | 4/1939 | Hays | 40/580 X |
| 4,587,753 | 5/1986 | Harper | 40/580 X |

FOREIGN PATENT DOCUMENTS

| | | | |
|---|---|---|---|
| 146413 | 4/1931 | Switzerland | 40/580 |

*Primary Examiner*—Kenneth J. Dorner
*Assistant Examiner*—James M. Gardner
*Attorney, Agent, or Firm*—Dominik, Stein, Saccocio, Reese, Colitz & VanDerWall

[57] ABSTRACT

An illuminated sign comprising a housing, illumination component within the housing and electrical components for powering the illumination component. The housing has a front wall with apertures representing information to be illuminated, sidewalls, a bottom wall, a back wall, an upper wall, the housing also has interior thereof a translucent panel positionable behind the front wall, a stencil panel with the apertures representing the information to be illuminated mounted behind the translucent panel, and a reflector within the housing. The illumination component is mounted on the rear of the stencil panel facing the back wall whereby illumination of the illumination component will reflect light from the back through the stencil panel, translucent panel, and the front wall. Electrical components feed current from the battery to the illumination component for effecting the illumination of the sign.

5 Claims, 4 Drawing Sheets

ILLUMINATED SIGN HAVING STENCIL PANEL AND REFLECTOR PANEL

BACKGROUND OF THE INVENTION

This invention relates to an illuminated sign and more particularly, to an exit sign which is internally illuminated by reflected light to render it highly visible in all ambient conditions and which has superior operating, maintenance, and manufacturing characteristics.

DESCRIPTION OF THE BACKGROUND ART

In the illuminated sign technology, not all such signs are adequately visible in all ambient conditions. An appropriately illuminated sign, particularly one for use as an exit sign, must be visible day or night whether under normal conditions or when in a room filled with smoke as caused by a fire. Such operating characteristics are not found in illuminated signs constructed in accordance with the present state of technology. Most illuminated signs known today employ bulbs which have short lives and give uneven illumination rendering such signs difficult to read under adverse conditions. As such, their utility in guiding people from an area of disaster is inadequate.

Typical types of illuminating mechanisms for exit signs include electroluminescent panels which inherently are of low intensity and incapable of being seen under bright light situations. Another is the use of bulbs, whether incandescent or light emitting diodes, extending outwardly from the face of the sign and configured in the shape of the letters to be read. Unfortunately, however, such signs are difficult to read when viewed at an angle other than straight, on and are easily "washed out" when flooded with light. Tritium illumination is also in common use but the visible light is less than acceptable, less than one foot Lambert. In addition, many people have a reluctance to use self-luminescent sources of illumination. Lastly, fluorescent lights are used but require extensive electronics and are of high costs.

Further, known adequately illuminated signs require frequent maintenance, are susceptible to tampering and have large power output requirements increasing the maintenance cost.

From a manufacturing standpoint, known illuminated signs generally are expensive and require the utilization of special parts.

The inadequacy of known illuminated signs for their intended functions is evidenced by a large number of designs known and in commercial use. By way of example, consider U.S. Pat. Nos. 850, 521 to Carter; 2,823,475 to Packard; 4,271,408 to Teshima, and 4,298,869 to Okuno which disclose reflectors for signs. Consider also U.S. Pat. Nos. 4,489,308 to Logan which discloses an emergency strobe light and 4,682,147 to Bowman which discloses bulbs in image configuration.

Note is also taken of the following patents which disclose circuiting for signs and related technology which are of general interest: 3,659,179 to Barker; 3,795,818 to Beaman; 3,869,639 to Herzog; 4,225,792 to Fahey; 4,238,690 to Clarke; 4,354,118 to Spencer; 4,386,308 to Emile, Jr.; 4,388,615 to Ford; 4,395,639 to Bring; and 4,544,910 to Hoberman.

Lastly, additional patents of interest include U.S. Pat. No. 4,723,119 to Morimoto and 4,752,771 to Katogi.

The present invention is an improvement over the prior art devices in that from an operating standpoint it is extremely effective, being highly visible in all ambient conditions. Its effectiveness is enhanced since it requires no replaceable bulbs, employs diffused light with a lens system, generates even illumination with no hot spots or visible bulbs, operates at a high intensity exceeding all standards and readily allows for the use of symbols such as arrows as an option.

From a maintenance standpoint, the present invention allows for long life, up to 200,000 hours or approximately 23 years, with no appreciable loss of light output thereby exceeding all standards, employs low power for cost reduction, is fabricated of high impact materials which are fire resistant, incorporates a design which is sealed to be tamper resistant and tamper evident, has long life sealed batteries and an associated visible indicator light on the front of the device.

From a manufacturing standpoint, the present invention is of low cost and simple to manufacture requiring n special parts.

Accordingly, it is an object of the present invention to provide an illuminated sign comprising a housing, illumination means within the housing and electrical components for powering the illumination means. The housing has a front piece formed of a front wall with apertures representing information to be illuminated, sidewalls extending rearwardly from the front wall and a bottom wall extending rearwardly from the front wall, the housing also has a back wall for mounting the sign in an appropriate orientation, and the housing also has an upper cover between the front wall and the back wall for allowing access to the interior of the housing, the housing also has interior thereof a translucent panel positionable behind the front wall, a stencil panel with the apertures representing the information to be illuminated mounted behind the translucent panel, a reflector panel mounted on the back wall and spacer posts separating the reflector panel from the stencil panel. The illumination means includes a plurality of light emitters mounted on the rear of the stencil panel facing the reflector panel and a reflective front surface on the reflector panel whereby illumination of the illumination means will reflect light from the reflector panel through the stencil panel, translucent panel, and the front wall. The electrical components comprise battery means and means to feed current from the battery means to the light emitters for effecting the illumination of the sign.

A further object of the present invention is to illuminate signs.

A further object of the present invention is to render signs highly visible under all ambient conditions.

A further object of the present invention is to extend the life of illuminated signs.

A further object of the present invention is to simplify the manufacturing of illuminated signs.

Lastly, a further object of the invention is to reduce the maintenance of illuminated signs.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention may be incorporated into an illuminated sign comprising a housing, illumination means within the housing and electrical components for powering the illumination means. The housing has a front piece formed of a front wall with apertures representing information to be illuminated, sidewalls extending rearwardly from the front wall and a bottom wall extending rearwardly from the front wall, the housing also has a back wall for mounting the sign in an appropriate orientation, and the housing also has an upper cover between the front wall and the back wall for allowing access to the interior of the housing, the housing also has interior thereof a translucent panel positionable behind the front wall, a stencil panel with the apertures representing the information to be illuminated mounted behind the translucent panel, a reflector panel mounted on the back wall and spacer posts separating the reflector panel from the stencil panel. The illumination means includes a plurality of light emitters mounted on the rear of the stencil panel facing the reflector panel and a reflective front surface on the reflector panel whereby illumination of the illumination means will reflect light from the reflector panel through the stencil panel, translucent panel, and the front wall. The electrical components comprise battery means and means to an improved feed current from the battery means to the light emitters for effecting the illumination of the sign.

In addition, the invention may be incorporated into an improved illuminated sign comprising a housing, illumination means within the housing and electrical components for powering the illumination means. The housing has a front wall with apertures representing information to be illuminated, sidewalls, a bottom wall, a back wall, and an upper wall. The housing also has interior thereof a translucent panel positionable behind the front wall, a stencil panel with the apertures representing the information to be illuminated mounted behind the translucent panel, and reflector means within the housing. The illumination means mounted on the rear of the stencil panel face the back wall whereby illumination of the illumination means reflects light from the back through the stencil panel, translucent panel, and the front wall, and the electrical component means to feed current to the illumination means for effecting the illumination of the sign.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
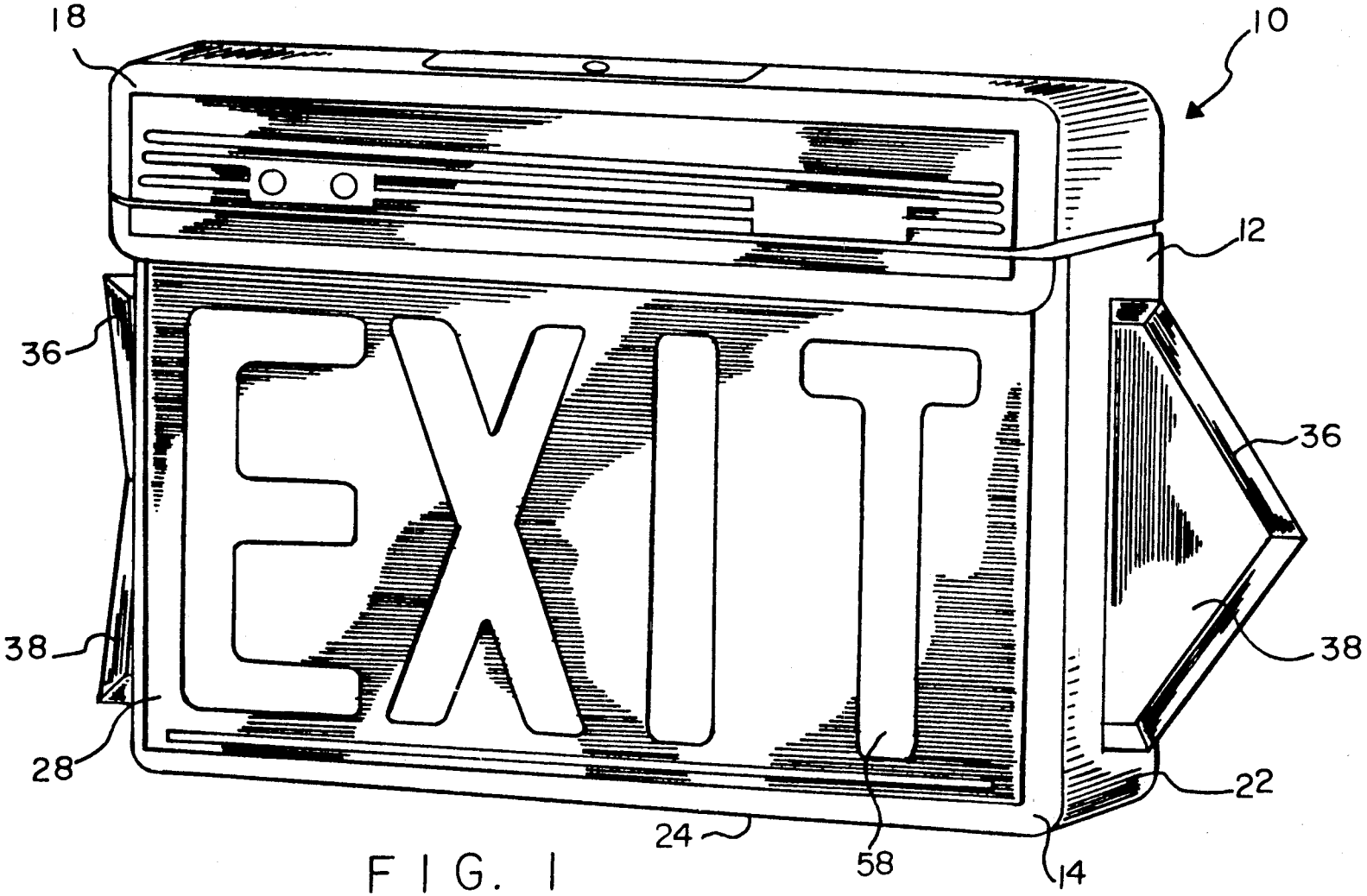
FIG. 1 is a perspective illustration of the illuminated sign constructed in accordance with the principles of the present invention.
Figure 2:
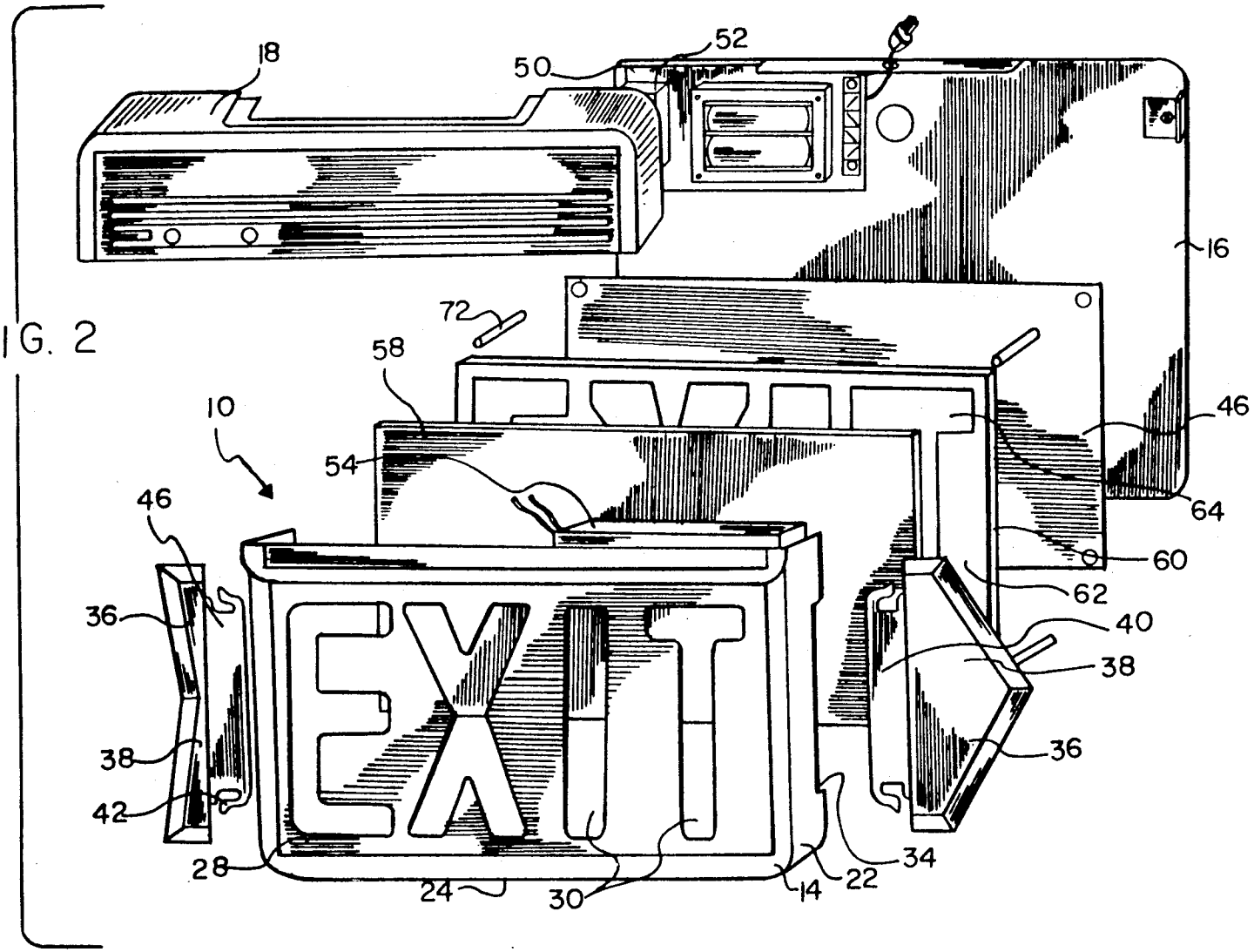
FIG. 2 is an exploded perspective view of the illuminated sign of FIG. 1.
Figure 3:
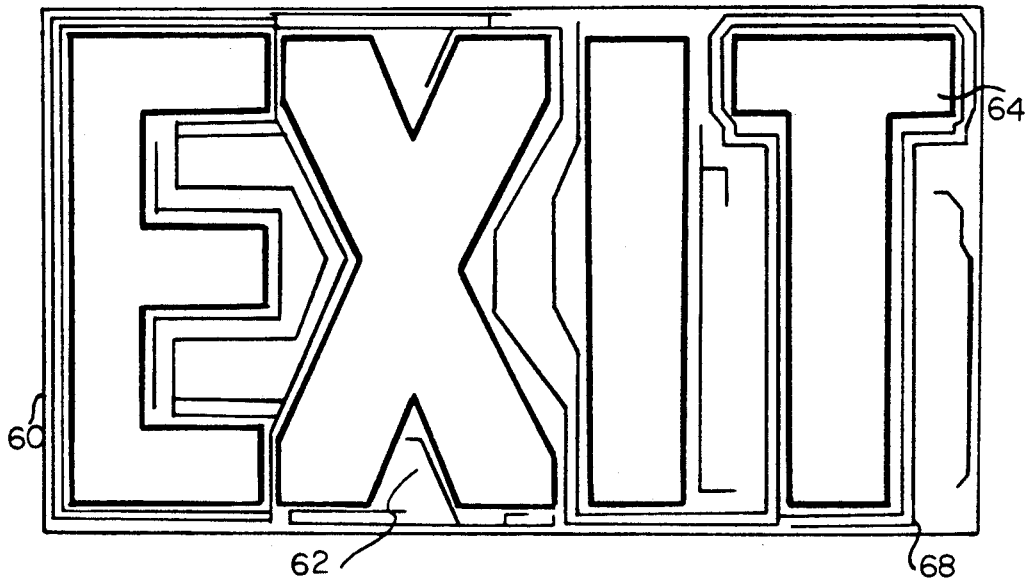
FIG. 3 is a plan view of the front face of the stencil panel.
Figure 4:
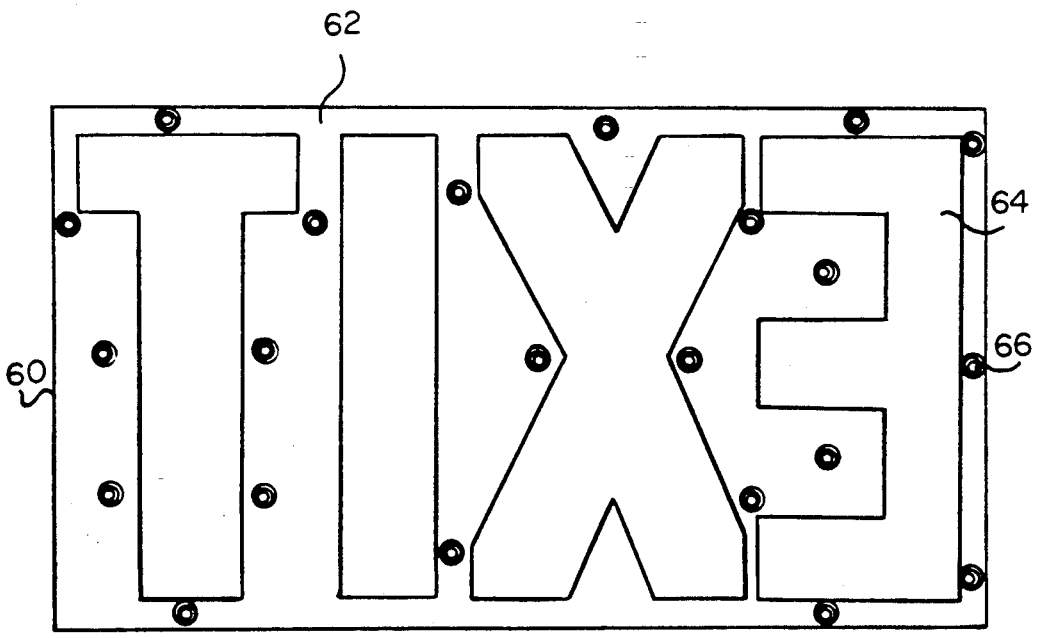
FIG. 4 is a plan view of the rear face of the stencil panel illustrating the light emitters.

Shown in the various FIGURES with particular reference to the exploded perspective showing of FIG. 2, there is illustrated the illuminate sign 10 constructed in accordance with the prefered embodiment of the present invention. A housing 12 is fabricated of tough, long life, fire resistant material such as "Lexan" or similar polymer. The housing includes a front piece 14, back panel 16 and upper cover 18 coupled with respect to each other for ease of assembly and maintenance. The front piece 14 includes rearwardly extending sidewalls 22 and extending bottom wall 24 whereby when coupled with the back and upper cover, a chamber 26 is defined therein for receiving the illumination mechanisms and the electrical controls therefor.

The front piece 14 includes a front wall 28 having apertures 30 therein formed to the shape of the light to be projected therethrough and the information to be conveyed. The remainder of the front piece as well as the back and upper cover are opaque to preclude light from escaping from the housing except through the apertures in the front wall. The sidewalls and bottom wall all extend rearwardly to the back panel except for cutouts 34 in the side panels. The cutouts are of a limited extent adjacent to the back panel. They are of such size, thickness and height, so as to accommodate side extensions 36.

In the preferred embodiment, the extensions are of a translucent material having external portions 38 extending outwardly from the sidewalls and internal portions 40 to effect their coupling with the sidewalls and housing. The internal portions are provided with resilient arms 42 movable toward each other upon the application of force. In this manner, the extensions may be slid into the housing through the cutouts at which time the arms resile inwardly until the internal portions are properly seated with their outer portions exposed. Removal of the extensions is effected upon separation of the front panel from the back panel so that the user may again resilient bend the arms inwardly to clear the upper and lower edges of the cutouts so that they may be slid outwardly and separated from the front piece. In the preferred embodiment, one exterior portion of the extensions is shaped in the form of the leading edge of an arrow while the other exterior portion is shaped in the form of a trailing edge of an arrow to indicate a direction for the observer to move toward the exit. The edges of the external portions are chamfered to improve optical contrast for viewability.

Figure 5:
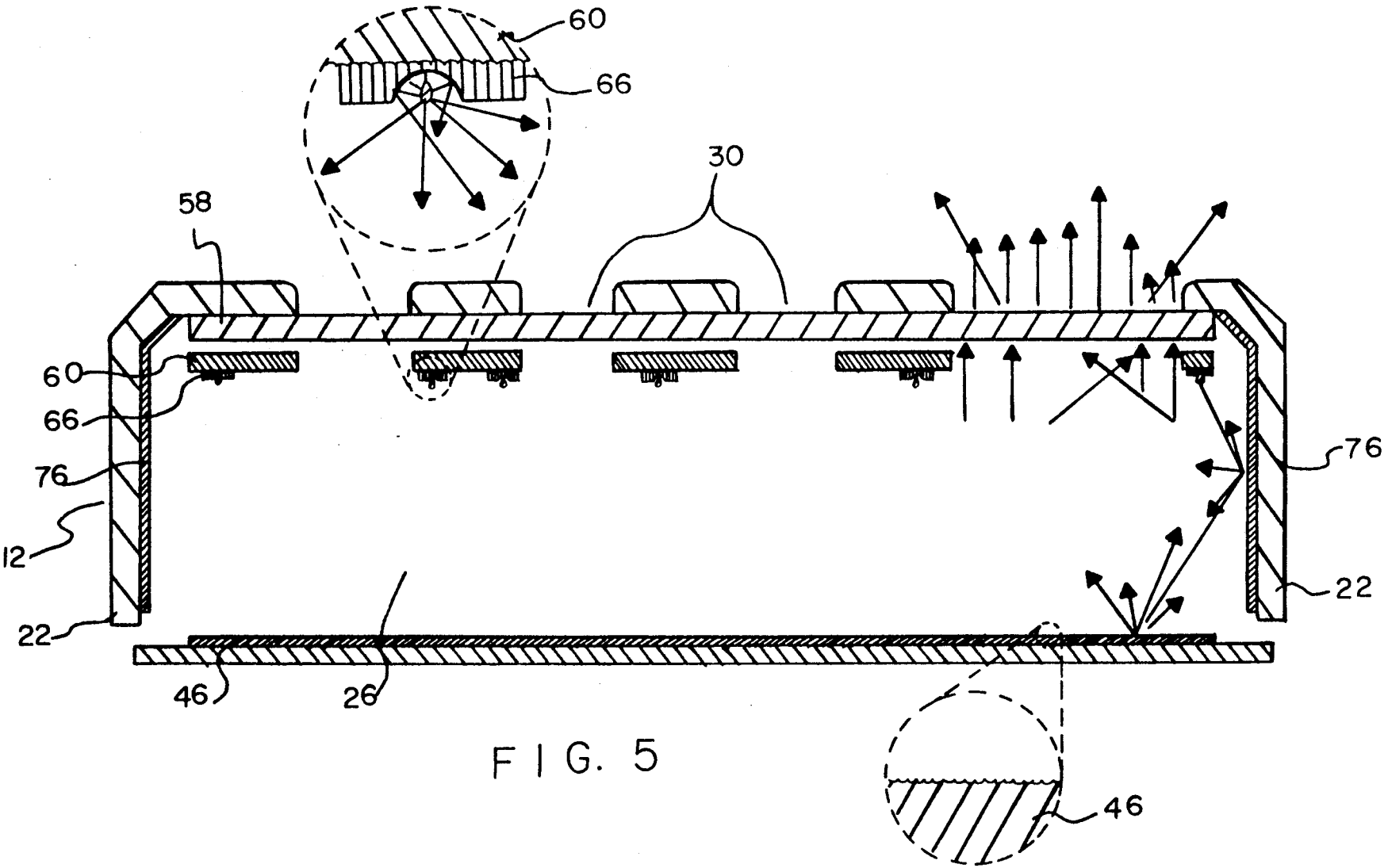
FIG. 5 is a sectional view taken horizontally through the center of the illuminated sign.

The back panel 16, like the front piece 14, is also fabricated of a durable fire resistant material. It has apertures at its corners for coupling with the front piece through elongated screws. Supported on the front face of the back panel is the reflector panel 46. The reflector panel is a sheet of material adapted to receive light from interior of the chamber and to reflect it forwardly through the apertures of the front wall. Note the lower blowout on FIG. 5. A preferred material for the reflector panel is ultra violet (UV) stabilized white polycarbonate or metal which provides a specular surface for diffusing the reflected light for maximum efficiency in the utilization of the light energy generated within the housing. Also located on the back panel near one corner thereof are the electronic components.

The electronic components are mounted on a sheet of circuit board material 50 such as phenolic, fiberglass or plastic and include a switch 52 having a finger extendable through an adjacent aperture in the sidewall of the front piece. Other electrical components are standard for converting the alternating current from the source to direct current as needed for powering the light emitters. Also located in the electronic components is a battery pack 54, preferably sealed lead acid for extended life. The battery pack is a back up in case of a power failure. A transformer converts the input voltage to a low level voltage of about 80-90 percent of the rated voltage of the light emitters during operation and use of the illuminated sign. In this regard, the electronic components are essentially conventional except for the use of the highest life and highest quality components consistent with the intended operation.

The third component of the housing is the upper cover 18. The upper cover has a front face essentially coplanar with the upper portion of the front piece. It also has sidewalls essentially coplanar with the sidewalls of the front piece as well as the upper cover. The upper cover has a forwardly extending recess for receiving a tab extension at right angles from the back panel. Standard coupling mechanisms effect the releasable coupling of the upper cover with the remainder of the housing. More specifically this may be accomplished with securing screws or pressure-friction fitting of the housing itself.

Also located within the housing is a translucent sheet 58, normally red, green, white, etc. in color in the preferred embodiment positionable on the interior surface of the front wall. The purpose of the translucent panel is to provide a highly visible color and contrast to the sign during operation and use whereby it may be effective for its informational purposes independent of the ambient condition surrounding the illuminated sign. Most particularly, the design is such that it may be viewed during the smoky conditions generated by a fire.

Located in immediate contact with the translucent panel is a stencil panel 60. The stencil panel has opaque portions 62 and apertures 64 corresponding to the apertures in the front wall. The rear face of the stencil panel supports a plurality of light emitting diodes 66 spaced on the panel facing toward the front face of the reflector panel. The light emmitting diodes are coupled to the electronic components by conductive traces 68 and leads whereby depressing of the finger switch will allow power to flow to the light emitting diodes 66 for their illumination thereupon the light may be reflected from the reflector panel 46 through the stencil panel 60, red translucent panel 58 and apertures 30 of the front wall 28 for effecting the intended illumination. The front surface of the translucent panel is preferably etched for allowing greater light intensity. If etched in image configuration, the front wall may be eliminated.

Spacer posts 72 between the corners of the reflector panel 46 and stencil panel 60 are used in association with the screws extending through the back panel to couple the various components of the housing except for the upper cover. During operation and use, the reflector panel and stencil panel are spaced a sufficient distance to allow appropriate specular refraction and diffusion of the light from the light emitters such as light emitting diodes off the reflector panels for being viewed by an observer of the sign.

The translucent panel or member 58 of the present invention is best thought of an optical member or optica. Typical transparent members in illuminated signs function as diffusers to spread out the light received on one side and passing to the other side. In the present invention, however, our translucent member 58 functions as the light emitter itself. This is effected by having the illumination chamber 26, on the interior side of the optica, act in such fashion that light from the sources of illumination are reflected and refracted by the plurality of appropriate specular reflecting surfaces on all sides of the chamber. This is effected by side strips 76 of material similar to the reflective panel 46. Such could also be provided on the rear face of the stencil panel 60. In the alternative, white semigloss paint could be utilized. In this manner, the light is evenly spread out fully before being received on the interior side of the optica. Such light passing through the optica the functions for observation on the exposed exterior side for full, complete and even illumination of the area imparting information, such as alphabetical characters, etc. The chamber is uninterrupted allowing full reflection and full refraction from all surfaces within the housing.

It has been found that the distance between the optica and the reflective sheet constitutes the focal length. The focal length is a function of the area of the optica. In those signs where the letters are six inches high and three fourths inches in width, a distance of one inch between the optica and reflective panel is preferred. In those situations where the letters are eight inches high and one inch thick, a focal length of 1.25 inches between the optica and reflective sheet is preferred or the addition of more light emitters if a thinner profile is desired. The distance between the optica and reflective panel can be reduced or increased with varying results on front surface illumination. The spherical surface behind the light emitters is made increasingly specular to reduce the amount of times the light must reflect from adjacent surfaces before striking the interior surface of the optica. The spherical shape functions to minimize the effect of the inverse square law of light.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described, What is claimed is:

1. An illuminated sign comprising:

a housing illumination means within the housing and electrical components for powering the illumination means;

the housing having a front piece formed of a front wall with apertures representing information to be illuminated, sidewalls extending rearwardly from the front wall and a bottom wall extending rearwardly from the front wall, the housing also having a back wall for mounting the sign in an appropriate orientation, and the housing also having an upper cover between the front wall and the back wall for allowing access to the interior of the housing, the housing also having interior thereof a translucent panel positionable behind the front wall and in facing contact therewith, an opaque stencil panel with apertures aligned with the apertures of the front wall and representing the information to be illuminated mounted behind the translucent panel and in facing contact therewith, a reflector panel mounted on the back wall and spacer posts separating the reflector panel from the stencil panel;

the illumination means including a plurality of light emitters mounted on the rear of the stencil panel facing the reflector panel and a reflective front surface on the reflector panel whereby illumination of the illumination means will reflect light from the reflector panel through the stencil panel, translucent panel, and the front wall; and the electrical components comprising battery means and means to feed current from the battery means to the light emitters for effecting the illumination of the sign.

2. An illuminated sign comprising:

a housing, illumination means within the housing and electrical components for powering the illumination means;

the housing having a front wall with apertures representing information to be illuminated, sidewalls, a bottom wall, a back wall, an upper wall, the housing also having interior thereof a translucent panel positionable behind the front wall and in facing contact therewith, an opaque stencil panel with apertures corresponding to the apertures of the front wall and representing the information to be illuminated mounted behind the translucent panel and in facing contact therewith, and reflector means within the housing;

the illumination means mounted on the rear of the opaque stencil panel facing the back wall whereby illumination of the illumination means will reflect light from the back through the stencil panel, translucent panel, and the front wall; and the electrical component means to feed current to the illumination means for effecting the illumination of the sign.

3. The sign as set forth in claim 2 wherein the space between the side walls of the housing is uninterrupted.

4. The sign as set forth in claim 3 wherein the side walls, top wall and bottom wall include reflector means.

5. The sign as set forth in claim 4 wherein the stencil panel includes reflector means facings the back wall.

* * * * *